United States Patent [19]

Colomer et al.

[11] Patent Number: 4,996,874

[45] Date of Patent: Mar. 5, 1991

[54] METHOD AND APPARATUS FOR TREATING COOLANT FOR INTERNAL COMBUSTION ENGINE

[76] Inventors: John T. Colomer, 4122 Miller Oaks Rd., McHenry, Ill. 60050; Lawrence G. DeRome; Raymond D. DeRome, both of 10401 - 336th Ave., Twin Lakes, Wis. 53181; Robert A. Remiasz, 9945 S. St. Louis Ave., Evergreen Park, Ill. 60642

[21] Appl. No.: 422,061

[22] Filed: Oct. 16, 1989

Related U.S. Application Data

[63] Continuation-in-part of Ser. No. 293,435, Jan. 4, 1989, abandoned.

[51] Int. Cl.[5] ..... G01M 15/00

[52] U.S. Cl. ..... 73/118.1; 73/49.7

[58] Field of Search ..... 73/118.1, 49.2, 49.7; 123/41.01

[56] References Cited

U.S. PATENT DOCUMENTS 4,791,890 12/1988 Miles et al. ..... 165/95 X 4,899,807 2/1990 Vataru et al. ..... 165/95 X

*Primary Examiner*—Jerry W. Myracle

*Attorney, Agent, or Firm*—Anthony S. Zummer

[57] ABSTRACT

The present invention is an apparatus and method for treating coolant for an internal combustion engine. A pump circulates the coolant from an internal combustion engine through a filter and returns the coolant to the internal combustion engine. After circulation, the coolant is delivered to a holding reservoir. Additives and other materials are delivered to an addition reservoir. A vacuum pump is connected to the internal combustion engine to reduce the vacuum air pressure within the cooling system to between 15 and 27 inches of mercury below atmospheric. The addition reservoir and holding reservoir are connected to the cooling system so that the material from the addition reservoir and from the holding reservoir are pulled into the cooling system because of the reduced pressure.

11 Claims, 1 Drawing Sheet

METHOD AND APPARATUS FOR TREATING COOLANT FOR INTERNAL COMBUSTION ENGINE

CROSS-REFERENCE TO RELATED APPLICATION

This is a continuation-in-part of the applicant's invention entitled Antifreeze Treatment System, Ser. No. 07/293,435, filed Jan. 4, 1989, now abandoned.

BACKGROUND OF THE INVENTION

The present invention relates to an improved method and apparatus for treating coolant for an internal combustion engine.

Presently, internal combustion engines utilize a closed coolant system for cooling the internal combustion engine wherein the engine block is cooled by a liquid coolant. The coolant is in turn pumped to a radiator, which is a heat exchanger, to cool the liquid coolant which is then returned to the engine block. It is common to utilize the coolant to provide heat to a passenger compartment of a motor vehicle wherein the heater is an auxiliary heat exchanger for cooling the coolant and simultaneously deliver heat to the passenger compartment.

A well accepted coolant which is used in many cooling systems is a formulation which is primarily ethylene glycol. Ethylene glycol is popular because it is efficient in carrying heat, and it has a low freezing point so that it will not freeze readily in cold weather.

Ethylene glycol coolant has a high boiling point and is also usable in the summertime. The ethylene glycol coolant then may be utilized in an internal combustion engine the year around. Typically, coolants which have ethylene glycol as their base contain various additives, such as, rust inhibitors, which prevent rust from building up in the cooling system. With the passage of time, the rust inhibitors tend to be used up and must be replenished.

Many service stations advise their customers that they should drain the coolant prior to a winter season and replace it with a fresh supply of coolant which contains all of the additives. The service stations disposed of ethylene glycol by dumping it into a municipal sewage system. However, the ethylene glycol has been found to be a pollutant and municipal sewage systems prohibit the dumping of ethylene glycol into the sewage system. Thus, the service stations can no longer discard the ethylene glycol quickly and conveniently in a municipal sewage system, and therefore, no longer advise their customers to change the coolant but rather suggest the addition of additives, such as, rust inhibitor, and replenishment of any lost ethylene glycol.

The utilization of an apparatus and method for testing, filling and purging closed fluid systems is taught in U. S. Pat. No. 4,782,689, issued May 8, 1988, Raymond D. DeRome. An engine coolant flush-filtering, using external gas pressure is taught in U.S. Pat. No. 4,793,403 issued Dec. 27, 1988, to Vataru et al., and a radiator construction is taught in U.S. Pat. No. 1,554,924, issued Sept. 22, 1925, to Shapiro.

SUMMARY OF THE INVENTION

The present invention is an improved method and apparatus for treating coolant for an internal combustion engine. The present invention includes an apparatus which pumps coolant from a cooling system of an internal combustion engine. A filter is provided for filtering the coolant from the cooling system. A holding reservoir reserves filtered coolant from the cooling system. A vacuum pump is selectively connected to the cooling system for reducing the pressure in a portion of the cooling system to a pressure below atmospheric. A valve connects the holding reservoir to the cooling system while the cooling system is under a reduced pressure to draw coolant into the cooling system.

The method includes the steps of filtering coolant from the cooling system, then holding coolant in a holding reservoir. Additional materials are added to an addition reservoir. The pressure in a portion of the cooling system is reduced. The added materials and the coolant from the holding reservoir are delivered to the cooling system because of the reduced pressure in the cooling system.

DESCRIPTION OF THE PREFERRED EMBODIMENT

Figure 1:
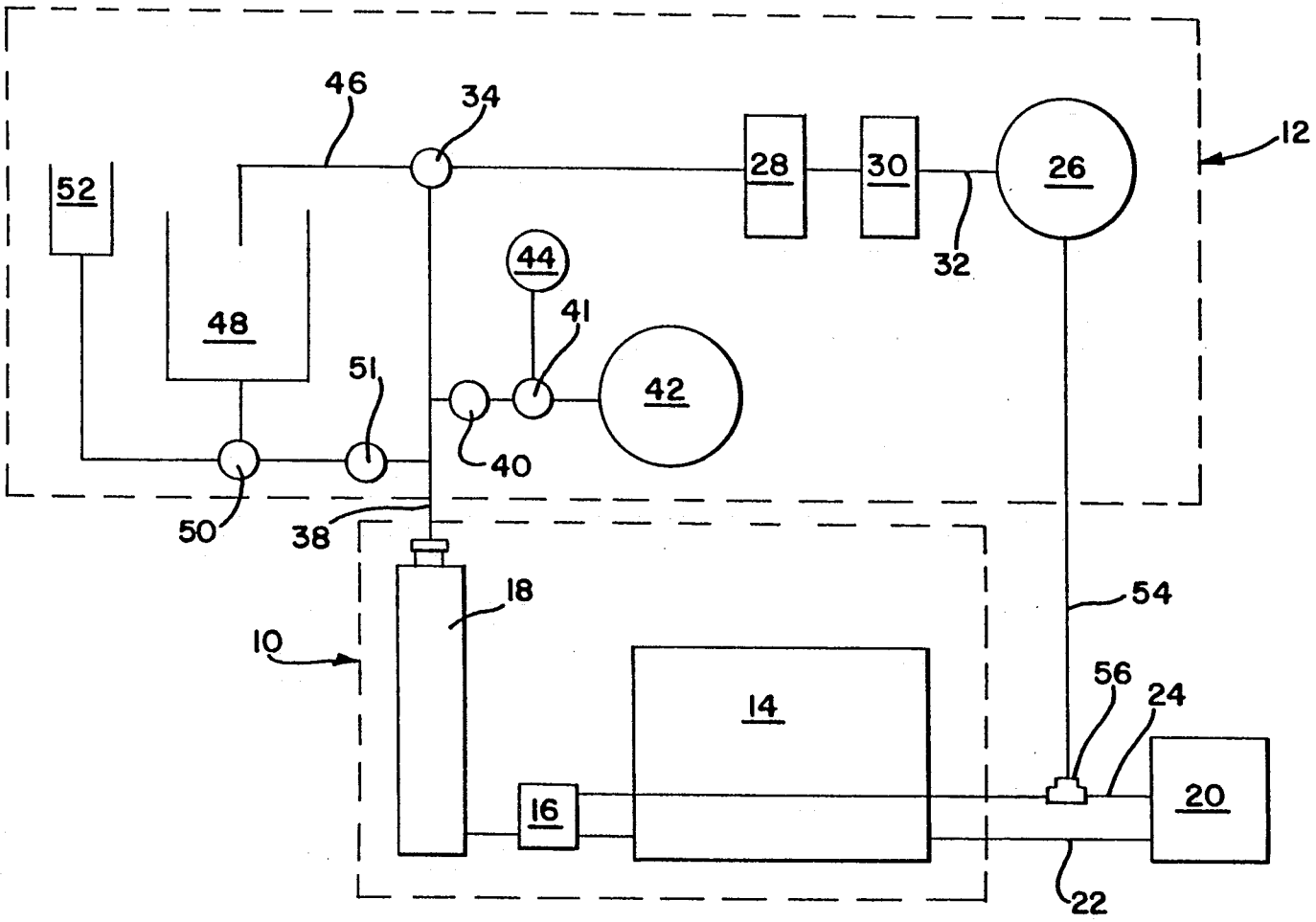
FIG. 1 is a schematic drawing showing the apparatus for treating coolant from an internal combustion engine connected to an internal combustion engine shown schematically in one arrangement of the connection of the apparatus to the internal combustion engine.

Referring now to the drawing, a conventional internal combustion engine 10 is shown therein schematically. An apparatus for treating coolant from a cooling system of an internal combustion engine is shown therein and identified generally by the numeral 12. The apparatus 12 is a specific embodiment of the herein disclosed invention.

As is conventional, internal combustion engine 10 generally includes an engine block 14 connected to a water pump 16 which is in turn connected to a conventional radiator 18. It may be appreciated that there are many other parts to a typical internal combustion engine which are not shown herein. A heater 20 is connected to engine block 14 for coolant to flow by hose 22 from the block to the heater. A return hose 24 connects the heater with water pump 16.

Apparatus 12 which is a specific embodiment of the herein disclosed invention, includes a suction pump 26 which is in this instance a compressed air operated diaphragm pump. The outlet of pump 26 is connected to a pair of conventional filters 28 and 30 by a conventional line 32. The filters 28 and 30 are connected to a control valve 34 through a line 36. The control valve 34 is connected to a conventional hose 38 which is adapted to be sealingly connected to an inlet of radiator 18. Hose 38 is connected to a vacuum valve 40. The vacuum valve is connected to a vacuum-test valve 41 which is connected to vacuum pump 42. In this instance, the vacuum pump is a Venturi pump which operates through compressed air. A conventional vacuum gauge 44 is connected to vacuum-test valve 41.

A line 46 is connected to a holding reservoir 48 which is connected to a reservoir valve 50. The reservoir valve 50 is connected to hose 38 through fill valve 51. Valve 50 is connected to an addition reservoir 52. The inlet to diaphragm pump 26 is connected to an inlet hose 54.

Before apparatus 12 is connected to internal combustion engine 10, coolant in the cooling system of the internal combustion engine is tested to determine the amount of any additives or other materials that need be added to the coolant. In some instances, it may be found necessary to add additional coolant to the cooling system. The additional coolant and additives are added to the addition reservoir 52 at a time convenient to an operator of the apparatus.

In order to connect apparatus 12 to the internal combustion engine 10, return hose 24 must be cut. Conventionally, a pair of clamps are place on hose 24 to prevent any loss of coolant from the cooling system. The clamps, which are not shown herein, are conventional and are well known in the art. Once the clamps are in position cutting off flow through the hose, a cut is made in the hose to separate the hose between the clamps. A tee 56 is inserted in hose 24 between the clamps. Hose 54 is then connected to tee 56. The clamps are then removed to allow coolant to flow through the tee. A conventional radiator cap, which is not shown herein, is removed from radiator 18, and hose 38 is sealingly connected to the inlet of radiator 18.

If there is a thermostat valve in the cooling system, it should be open, and the heater should be placed into an open attitude to allow coolant to flow through heater 20. Diaphragm pump 26 is operated by compressed air. The low pressure side of the diaphragm pump draws coolant from the cooling system of the internal combustion engine. The pump 26 forces the coolant through filters 28 and 30, and the filtered coolant is then returned to the radiator. Thus, the coolant is circulated through the radiator and engine block and through the filters 28 and 30 to remove impurities from the coolant. The coolant is circulated an appropriate length of time so that all of the coolant is filtered and impurities which may be contained in the radiator, engine block, and other parts of the cooling system are carried to filters 28 and 30.

Control valve 34 is shifted so that the coolant is delivered to line 46 and to holding reservoir 48. Hose 38 is disconnected from the radiator so that air may enter the cooling system as the coolant is pumped out of the cooling system. The diaphragm pump 26 is operated until it is observed that air is being drawn into the diaphragm pump signaling that all of the coolant which may be removed from the system has been removed; however, a portion of the coolant remains in the cooling system. The operation of the diaphragm pump 26 is then interrupted. Hose 54 is disconnected from tee 56, and the arm of the tee to which hose 54 was connected is closed.

Vacuum valve 40 is sealingly connected to the radiator. The vacuum pump is operated to reduce the pressure in the cooling system to about 15 to 27 inches of mercury with 27 inches being preferred. The operation of the vacuum pump is interrupted. Vacuum-test valve 41 is operated to connect gage 44 to the cooling system. The pressure in the cooling system is observed. If it is noted that there is an increase in pressure in the cooling system, then it is evident that there is a leak in the cooling system. On the other hand, if the pressure remains relatively stable, there is no leak in the system.

The fill valve 51 is opened to allow liquid from the addition reservoir to flow into the cooling system. Once the addition reservoir is empty, the reservoir valve 50 shifts to allow coolant from holding reservoir 48 to be drawn into the cooling system because of the reduced pressure in the cooling system. The coolant stops flowing from the holding reservoir when the pressure in the cooling system reaches atmospheric and thereby the cooling system is filled. The hose is removed from the radiator neck, and the conventional cap is replaced.

From the foregoing description, it is clear that there is no spillage or waste of the coolant. Furthermore, the operation of both pumps utilizes compressed air so that it is not necessary to use any electricity for the operation of either pump.

Although a specific embodiment of the herein disclosed apparatus and method has been shown and described in detail above, it is readily apparent that those skilled in the art may make various modifications and changes without departing from the spirit and scope of the present invention. It is to be expressly understood that the instant invention is limited only by the appended claims.

We claim:

1. An apparatus for treating coolant for an internal combustion engine comprising, in combination, means for pumping coolant out from an internal combustion engine, means for filtering the coolant pumped from the combustion engine before its return to the internal combustion engine, means for holding coolant from the internal combustion engine being selectively connected to the means for pumping coolant from the internal combustion engine, means for selectively creating a reduced pressure in a portion of a cooling system of the internal combustion engine, and means for connecting the means for holding coolant from the internal combustion engine while there is a reduced pressure in the cooling system of the internal combustion engine to draw coolant from the means of holding coolant to deliver coolant to the cooling system of the internal combustion engine.

2. An apparatus for treating coolant for an internal combustion engine as defined in claim 1, including a gauge selectively connectable to the cooling system of the internal combustion engine to determine whether there is an increase in reduced pressure in the internal combustion engine when operation of the means for selectively creating a reduced pressure is interrupted to indicate whether there is a leak in the cooling system.

3. An apparatus for treating coolant for an internal combustion engine as defined in claim 2, including a vacuum test valve connected to the gauge and being connectable to the cooling system for selectively connecting the gauge to the cooling system.

4. An apparatus for treating coolant for an internal combustion engine as defined in claim 1, including an addition reservoir for receiving materials for addition to the cooling system being selectively connectable to the cooling system.

5. An apparatus for treating coolant for an internal combustion engine as defined in claim 4, including a reservoir valve connected to the addition reservoir and the means for holding coolant to allow materials from the addition reservoir to flow into the coolant system before coolant from the means for holding coolant is returned to the cooling system.

6. An apparatus for treating coolant for an internal combustion engine as defined in claim 1, including a vacuum test valve selectively connectable to the cooling system, a gauge connected to the vacuum test valve and for selectively indicating the amount of reduced pressure in a portion of the cooling system to determine whether there is a leak in the cooling system, a reservoir valve connected to the means for holding coolant from the internal combustion engine, and an addition reservoir connected to the reservoir valve, whereby the reservoir valve allows materials from the addition reservoir to flow into the cooling system of the internal combustion engine prior to flow of coolant from the means for holding coolant from the internal combustion engine flowing into the cooling system of the internal combustion engine.

7. A method of treating coolant from a cooling system of an internal combustion engine and testing fluid tightness of the cooling system, comprising the steps of: filtering coolant from the cooling system of the internal combustion engine, delivering a portion of the coolant from the cooling system to a holding reservoir, adding materials to an additional reservoir, reducing the pressure in the cooling system to below atmospheric, delivering materials from the additional reservoir to the cooling system, and returning coolant from the holding reservoir to the cooling system.

8. A method of treating coolant from a cooling system of an internal combustion engine and testing fluid tightness of the cooling system as defined in claim 7, including; observing the amount of reduced pressure in the cooling system when no further reduction in pressure is being applied to determine whether there is a leak in the cooling system.

9. A method of treating coolant from a cooling system of an internal combustion engine and testing fluid tightness of the cooling system as defined in claim 7, including; testing the coolant in the cooling system to determine the amount of materials required to be added to the cooling system.

10. A method of treating coolant from a cooling system of an internal combustion engine and testing fluid tightness of the cooling system as defined in claim 7, including; testing the coolant in a cooling system of an internal combustion engine to determine the amount of materials required for the cooling system, and means for observing the reduced pressure in the cooling system while no further reduction of pressure is applied to the cooling system to determine whether there is a leak in the cooling system.

11. A method of treating coolant from a cooling system of an internal combustion engine and testing fluid tightness of the cooling system, comprising the steps of: testing coolant in a cooling system of an internal combustion engine to determine the need for additives and supplemental coolant, circulating the coolant from the internal combustion engine through a filter, delivering a portion of the coolant in a cooling system of a internal combustion engine to a holding reservoir, reducing the pressure in a portion of the cooling system to a pressure below atmospheric in the range of 15 to 27 inches of mercury, holding the reduced pressure for a selected period of time, observing the reduced pressure while it is being held to determine whether there is a leak in the cooling system, delivering additives to the cooling system, and returning a portion of the removed coolant from the holding reservoir.

* * * * *